US007115080B2

(12) United States Patent
Cockrill, Jr. et al.

(10) Patent No.: US 7,115,080 B2
(45) Date of Patent: Oct. 3, 2006

(54) COLLAPSIBLE SEAT FOR COMBINATION HACK SQUAT AND LEG PRESS MACHINE

(75) Inventors: Albert H. Cockrill, Jr., Longmont, CO (US); Hugh Nollette, Xinglin (CN)

(73) Assignee: Nautilus, Inc., Vancouver, WA (US)

( * ) Notice: Subject to any disclaimer, the term of this patent is extended or adjusted under 35 U.S.C. 154(b) by 214 days.

(21) Appl. No.: 10/211,429

(22) Filed: Aug. 1, 2002

(65) Prior Publication Data

US 2004/0023760 A1 Feb. 5, 2004

(51) Int. Cl.
*A63B 21/00* (2006.01)
*A63B 21/06* (2006.01)
*A63B 21/062* (2006.01)

(52) U.S. Cl. ..... 482/138; 482/94; 482/101

(58) Field of Classification Search ..... 482/93–94, 482/97, 100–104, 137–138
See application file for complete search history.

(56) References Cited

U.S. PATENT DOCUMENTS

| | | | |
|---|---|---|---|
| 37,713 | A | 2/1863 | Van Houten |
| 43,149 | A | 6/1864 | Wood |
| 108,401 | A | 10/1870 | Smith |
| 192,338 | A | 6/1877 | Marshall |
| 393,265 | A | 11/1888 | Rice |
| 457,400 | A | 8/1891 | Dowd |
| 511,251 | A | 12/1893 | Pickles |
| 551,803 | A | 12/1895 | Whitely |
| 595,492 | A | 12/1897 | McFadden |
| 629,655 | A | 7/1899 | Bryon, Jr. |
| 664,210 | A | 12/1900 | Bryon, Jr. |
| 684,688 | A | 10/1901 | Herz |
| 685,788 | A | 11/1901 | McFadden |
| 691,538 | A | 1/1902 | Frigerio |
| 716,520 | A | 12/1902 | Cole |
| 763,475 | A | 6/1904 | Frazee et al. |
| 772,906 | A | 10/1904 | Reach |
| 776,824 | A | 12/1904 | Byron, Jr. |
| 799,270 | A | 9/1905 | Roland |
| 848,272 | A | 3/1907 | Thornley |
| 885,074 | A | 4/1908 | Nidever |
| 1,053,109 | A | 2/1913 | Reach |
| 1,205,426 | A | 11/1916 | Barnhill |
| 1,371,750 | A | 3/1921 | Fox |
| 1,547,268 | A | 7/1925 | Sotomayor |

(Continued)

FOREIGN PATENT DOCUMENTS

CA 1 183 882 3/1985

(Continued)

OTHER PUBLICATIONS

Tuff Stuff Catalog, p. 3□□received Mar. 1998.*

(Continued)

*Primary Examiner*—Gregory Huson
*Assistant Examiner*—Fenn C. Mathew
(74) *Attorney, Agent, or Firm*—Dorsey & Whitney LLP

(57) ABSTRACT

An exercise machine for performing both a hack squat exercise and a leg press exercise is disclosed. A hack squat platform is operably mounted to a frame for use in performing a hack squat exercise. A collapsible seat is operably connected to either the frame or the hack squat platform for use in performing a leg press exercise. The collapsible seat and the hack squat platform are provided as alternative configurations whereby only one of either the collapsible seat or the hack squat platform can be used by the user at one time.

13 Claims, 4 Drawing Sheets

U.S. PATENT DOCUMENTS

| | | | | |
|---|---|---|---|---|
| 1,585,748 | A | | 5/1926 | Wendelken |
| 1,646,818 | A | | 10/1927 | Holland |
| 1,703,104 | A | | 2/1929 | Hassler |
| 1,745,435 | A | | 2/1930 | Mensendieck |
| 1,867,642 | A | | 7/1932 | Woods |
| 1,928,089 | A | | 9/1933 | Blickman |
| 2,131,570 | A | | 9/1938 | Riley |
| 2,223,309 | A | | 11/1940 | Swanson |
| 2,436,987 | A | | 3/1948 | Bailleaux |
| 2,632,645 | A | | 3/1953 | Barkschat |
| 2,753,722 | A | | 7/1956 | De Grave |
| 2,788,211 | A | | 4/1957 | Ivanoff |
| 2,921,791 | A | | 1/1960 | Berne |
| 2,944,592 | A | | 7/1960 | Halter |
| 2,977,120 | A | | 3/1961 | Morris |
| 3,306,611 | A | | 2/1967 | Gaul |
| 3,309,084 | A | | 3/1967 | Simmons |
| 3,323,366 | A | | 6/1967 | DeLorme, Jr. et al. |
| 3,342,485 | A | | 9/1967 | Gaul |
| 3,379,439 | A | | 4/1968 | Sorenson et al. |
| 3,550,523 | A | | 12/1970 | Segal |
| 3,567,219 | A | | 3/1971 | Foster |
| 3,575,058 | A | | 4/1971 | Kraus |
| 3,588,101 | A | | 6/1971 | Jungreis |
| 3,596,907 | A | | 8/1971 | Brighton et al. |
| 3,598,404 | A | | 8/1971 | Bowman |
| 3,614,097 | A | | 10/1971 | Blickman |
| 3,638,941 | A | | 2/1972 | Kulkens |
| 3,647,209 | A | | 3/1972 | La Lanne |
| 3,658,327 | A | | 4/1972 | Thiede |
| 3,662,602 | A | | 5/1972 | Weiss |
| 3,701,529 | A | | 10/1972 | Kruthaupt |
| 3,707,285 | A | | 12/1972 | Martin |
| 3,708,167 | A | | 1/1973 | Potgieter |
| 3,712,613 | A | | 1/1973 | Feather et al. |
| 3,734,495 | A | | 5/1973 | Nist et al. |
| 3,752,473 | A | | 8/1973 | La Lanne |
| 3,759,512 | A | | 9/1973 | Yount et al. |
| 3,822,599 | A | | 7/1974 | Brentham |
| 3,850,431 | A | | 11/1974 | Winans |
| 3,856,297 | A | | 12/1974 | Schnell |
| 3,858,873 | A | | 1/1975 | Jones |
| 3,912,261 | A | | 10/1975 | Lambert, Sr. |
| 3,970,302 | A | | 7/1976 | McFee |
| 3,981,500 | A | | 9/1976 | Ryan |
| 3,998,454 | A | | 12/1976 | Jones |
| 4,063,727 | A | | 12/1977 | Hall |
| 4,066,259 | A | | 1/1978 | Brentham |
| 4,082,267 | A | | 4/1978 | Flavell |
| 4,109,907 | A | | 8/1978 | Zito |
| 4,111,414 | A | | 9/1978 | Roberts |
| 4,114,610 | A | | 9/1978 | Koch |
| 4,129,297 | A | | 12/1978 | Dolan |
| 4,130,014 | A | | 12/1978 | Eddens |
| 4,149,713 | A | | 4/1979 | McLeod |
| 4,154,441 | A | | 5/1979 | Gajda |
| 4,200,279 | A | | 4/1980 | Lambert, Jr. |
| 4,204,676 | A | | 5/1980 | Givens |
| 4,208,049 | A | | 6/1980 | Wilson |
| D256,821 | S | | 9/1980 | Weider |
| 4,229,002 | A | | 10/1980 | Masters |
| 4,231,568 | A | | 11/1980 | Riley et al. |
| 4,240,626 | A | | 12/1980 | Lambert, Jr. |
| 4,240,627 | A | | 12/1980 | Brentham |
| 4,247,098 | A | | 1/1981 | Brentham |
| 4,254,949 | A | | 3/1981 | Brentham |
| 4,257,592 | A | | 3/1981 | Jones |
| 4,296,924 | A | | 10/1981 | Anzaldua et al. |
| 4,328,965 | A | | 5/1982 | Hatfield |
| 4,333,644 | A | * | 6/1982 | Lambert et al. ..... 482/101 |
| 4,336,934 | A | | 6/1982 | Hanagan et al. |
| 4,349,192 | A | | 9/1982 | Lambert, Jr. et al. |
| 4,349,193 | A | | 9/1982 | Lambert, Jr. et al. |
| 4,354,675 | A | | 10/1982 | Barclay et al. |
| 4,357,010 | A | | 11/1982 | Telle |
| 4,357,011 | A | | 11/1982 | Voris |
| RE31,113 | E | | 12/1982 | Coker et al. |
| 4,363,480 | A | | 12/1982 | Fisher et al. |
| 4,387,893 | A | | 6/1983 | Baldwin |
| 4,387,894 | A | | 6/1983 | Baumann |
| 4,397,462 | A | | 8/1983 | Wilmarth |
| 4,398,713 | A | | 8/1983 | Ellis |
| 4,402,505 | A | | 9/1983 | Young |
| 4,405,128 | A | | 9/1983 | McLaughlin et al. |
| 4,407,503 | A | | 10/1983 | Nishizawa |
| 4,411,421 | A | | 10/1983 | Hershberger |
| 4,411,424 | A | | 10/1983 | Barnett |
| 4,426,077 | A | | 1/1984 | Becker |
| 4,428,578 | A | | 1/1984 | Kirkpatrick |
| 4,429,871 | A | | 2/1984 | Flechner |
| 4,456,245 | A | | 6/1984 | Baldwin |
| 4,466,613 | A | | 8/1984 | Reese |
| 4,478,411 | A | | 10/1984 | Baldwin |
| 4,478,413 | A | | 10/1984 | Siwula |
| 4,493,485 | A | | 1/1985 | Jones |
| 4,494,662 | A | | 1/1985 | Clymer |
| 4,500,089 | A | | 2/1985 | Jones |
| 4,502,681 | A | | 3/1985 | Blomqvist |
| 4,505,475 | A | | 3/1985 | Olschansky et al. |
| 4,511,137 | A | | 4/1985 | Jones |
| 4,512,571 | A | | 4/1985 | Hermelin |
| 4,515,363 | A | | 5/1985 | Schleffendorf |
| 4,535,985 | A | * | 8/1985 | Mask ..... 482/94 |
| 4,536,027 | A | * | 8/1985 | Brennan ..... 297/124 |
| 4,540,171 | A | | 9/1985 | Clark et al. |
| 4,542,899 | A | | 9/1985 | Hendricks |
| 4,546,971 | A | | 10/1985 | Raasoch |
| 4,549,733 | A | | 10/1985 | Salyer |
| 4,555,109 | A | | 11/1985 | Hartmann |
| 4,568,078 | A | | 2/1986 | Weiss |
| 4,589,656 | A | | 5/1986 | Baldwin |
| D284,597 | S | | 7/1986 | Smith et al. |
| 4,598,908 | A | | 7/1986 | Morgan |
| 4,600,196 | A | | 7/1986 | Jones |
| 4,601,466 | A | | 7/1986 | Lais |
| 4,602,373 | A | | 7/1986 | Dorfman |
| 4,603,855 | A | | 8/1986 | Sebelle |
| 4,605,389 | A | | 8/1986 | Westhoff |
| 4,606,541 | A | | 8/1986 | Cunningham |
| 4,609,189 | A | | 9/1986 | Brasher |
| 4,609,193 | A | | 9/1986 | Paris et al. |
| 4,620,704 | A | | 11/1986 | Shifferaw |
| 4,621,807 | A | | 11/1986 | Stramer |
| 4,624,457 | A | | 11/1986 | Silberman et al. |
| 4,627,615 | A | | 12/1986 | Nurkowski |
| 4,629,185 | A | | 12/1986 | Amann |
| 4,632,388 | A | | 12/1986 | Schleffendorf |
| 4,632,390 | A | | 12/1986 | Richey |
| 4,634,118 | A | | 1/1987 | Jensen |
| 4,634,127 | A | | 1/1987 | Rockwell |
| 4,635,926 | A | | 1/1987 | Minkow |
| 4,640,508 | A | | 2/1987 | Escher |
| 4,643,420 | A | | 2/1987 | Riley et al. |
| 4,645,205 | A | | 2/1987 | Wolff |
| 4,653,750 | A | | 3/1987 | McIntyre |
| 4,666,149 | A | | 5/1987 | Olschansky et al. |
| 4,666,152 | A | | 5/1987 | Jones |
| 4,684,124 | A | | 8/1987 | Escher |
| 4,685,670 | A | | 8/1987 | Zinkin |
| 4,690,402 | A | | 9/1987 | Basting |
| 4,697,809 | A | | 10/1987 | Rockwell |
| 4,700,944 | A | | 10/1987 | Sterba et al. |
| 4,703,928 | A | | 11/1987 | Escher |
| 4,709,918 | A | | 12/1987 | Grinblat |

4,709,920 A 12/1987 Schnell
4,721,303 A 1/1988 Fitzpatrick
4,722,522 A 2/1988 Lundgren
4,725,056 A 2/1988 Rehrl et al.
4,725,057 A 2/1988 Shifferaw
4,730,828 A 3/1988 Lane
4,730,829 A 3/1988 Carlson
4,732,381 A 3/1988 Skowronski
4,733,860 A 3/1988 Steffee
4,743,011 A 5/1988 Coffey
4,749,182 A 6/1988 Duggan
4,749,189 A 6/1988 Frank
4,750,736 A 6/1988 Watterson
4,753,126 A 6/1988 Sammaratano
4,756,527 A 7/1988 Ledbetter
4,763,897 A 8/1988 Yakata
4,765,613 A 8/1988 Voris
4,765,614 A 8/1988 Shute
4,768,779 A 9/1988 Oehman, Jr. et al.
4,772,015 A 9/1988 Carlson et al.
4,773,398 A 9/1988 Tatom
4,781,374 A 11/1988 Lederman
4,793,608 A 12/1988 Mahnke et al.
D299,371 S 1/1989 Tsuyama
4,795,149 A 1/1989 Pearson
4,796,881 A 1/1989 Watterson
4,809,972 A 3/1989 Rasmussen et al.
4,809,973 A 3/1989 Johns
4,813,667 A 3/1989 Watterson
4,815,746 A 3/1989 Ward, Jr.
4,822,032 A 4/1989 Whitmore et al.
4,822,036 A 4/1989 Dang
4,824,104 A 4/1989 Bloch
4,826,153 A 5/1989 Schalip
4,826,157 A 5/1989 Fitzpatrick
4,834,365 A 5/1989 Jones
4,834,367 A 5/1989 Salyer et al.
4,836,536 A 6/1989 Jones
4,836,537 A 6/1989 Moreno
4,838,548 A 6/1989 Maag
4,840,373 A 6/1989 Maag
4,842,268 A 6/1989 Jenkins
4,842,271 A 6/1989 Vinciguerra
4,842,272 A 6/1989 Jennings
4,844,456 A 7/1989 Habing et al.
4,846,458 A 7/1989 Potts
4,848,741 A 7/1989 Hermanson
4,858,915 A 8/1989 Szabo
4,858,917 A 8/1989 Montgomery
4,861,025 A 8/1989 Rockwell
4,863,161 A 9/1989 Telle
4,863,163 A 9/1989 Wehrell
4,872,668 A 10/1989 McGillis et al.
4,872,670 A 10/1989 Nichols
4,878,397 A 11/1989 Lennon
4,878,662 A 11/1989 Chern
4,878,663 A 11/1989 Luquette
4,883,270 A 11/1989 Maag
4,889,336 A 12/1989 Schneiderman
4,890,830 A 1/1990 Kern
D306,050 S 2/1990 Brentham
4,898,381 A 2/1990 Gordon
4,900,018 A 2/1990 Ish, III et al.
4,902,009 A 2/1990 Jones
4,907,798 A 3/1990 Burchatz
4,911,435 A 3/1990 Johns
4,911,438 A 3/1990 Van Straaten
4,913,423 A 4/1990 Farran et al.
D307,782 S 5/1990 Birrell et al.
4,921,242 A 5/1990 Watterson
4,944,511 A 7/1990 Francis
4,949,951 A 8/1990 Deola
4,961,428 A 10/1990 Nikias et al.
4,974,838 A 12/1990 Sollenberger
4,979,737 A 12/1990 Kock
4,986,538 A 1/1991 Ish, III
4,988,095 A 1/1991 Ferrari
4,993,666 A * 2/1991 Baymak et al. ..... 244/122 R
5,000,446 A 3/1991 Sarno
5,002,271 A 3/1991 Gonzales
5,011,139 A 4/1991 Towley
D317,032 S 5/1991 Eckler
5,018,725 A 5/1991 Cook
5,020,794 A 6/1991 Englehardt et al.
D317,959 S 7/1991 Francis
5,029,850 A 7/1991 van Straaten
5,037,089 A 8/1991 Spagnuolo et al.
5,039,091 A 8/1991 Johnson
5,042,798 A 8/1991 Sawicky
5,042,799 A 8/1991 Stanley
5,042,801 A 8/1991 Sterba et al.
5,044,629 A 9/1991 Ryan et al.
5,044,631 A 9/1991 Jones
5,044,632 A 9/1991 Jones
5,050,873 A 9/1991 Jones
D321,025 S 10/1991 Jones
D321,026 S 10/1991 Jones
D321,027 S 10/1991 Jones
D321,028 S 10/1991 Jones
5,056,779 A 10/1991 Webb
5,060,938 A 10/1991 Hawley, Jr.
5,060,939 A 10/1991 Oswald et al.
D321,387 S 11/1991 Jones
D321,389 S 11/1991 Jones
D321,390 S 11/1991 Jones
D321,391 S 11/1991 Jones
5,062,632 A 11/1991 Dalebout et al.
5,062,633 A 11/1991 Engel et al.
5,064,191 A 11/1991 Johnson
5,066,003 A 11/1991 Jones
5,066,004 A 11/1991 Jones
5,069,447 A 12/1991 Snyderman et al.
5,076,576 A 12/1991 Johnston
5,076,577 A 12/1991 Houston
5,076,578 A 12/1991 Askonen
5,076,579 A 12/1991 Rickey
5,080,349 A 1/1992 Vittone
5,080,351 A 1/1992 Rockwell
5,085,430 A 2/1992 Habing
5,089,960 A 2/1992 Sweeney, Jr.
5,090,694 A 2/1992 Pauls et al.
D324,710 S 3/1992 Habing
5,094,124 A 3/1992 Stonehouse
5,094,449 A 3/1992 Stearns
5,100,131 A 3/1992 Fong
5,102,121 A 4/1992 Solow
5,102,122 A 4/1992 Piane, Jr. et al.
5,104,121 A 4/1992 Webb
5,106,080 A 4/1992 Jones
5,106,081 A 4/1992 Webb
5,106,083 A 4/1992 Hall
5,108,095 A 4/1992 Nichols
5,116,297 A 5/1992 Stonecipher
5,120,289 A 6/1992 Yu
5,122,106 A 6/1992 Atwood et al.
5,123,886 A 6/1992 Cook
5,125,881 A 6/1992 Jones
5,125,882 A 6/1992 La Mothe et al.
D328,320 S 7/1992 Hliang
5,135,216 A 8/1992 Bingham et al.
5,135,449 A 8/1992 Jones
5,135,453 A 8/1992 Sollenberger
5,135,456 A 8/1992 Jones
5,135,458 A 8/1992 Huang
5,135,459 A 8/1992 Perry, Jr.
5,145,479 A 9/1992 Olschansky et al.

5,147,265 A 9/1992 Pauls et al.
5,171,198 A 12/1992 Jones
5,180,354 A 1/1993 Jones
5,181,896 A 1/1993 Jones
D334,042 S 3/1993 Wang
5,190,513 A 3/1993 Habing et al.
5,195,937 A 3/1993 Engel et al.
5,199,935 A 4/1993 Gibson et al.
5,203,755 A 4/1993 Kaiser
5,205,802 A 4/1993 Swisher
5,205,804 A 4/1993 Hall
D335,511 S 5/1993 Engel et al.
5,209,461 A 5/1993 Whightsil, Sr.
5,211,614 A 5/1993 Henes
D336,498 S 6/1993 Engel et al.
5,217,487 A 6/1993 Engel et al.
5,221,244 A 6/1993 Doss
5,221,245 A 6/1993 Yeh
D337,361 S 7/1993 Engel et al.
D337,666 S 7/1993 Peterson et al.
5,226,867 A 7/1993 Beal
5,230,680 A 7/1993 Wu
5,236,406 A 8/1993 Webber
5,242,344 A 9/1993 Hundley
5,242,347 A 9/1993 Keeton
5,244,444 A 9/1993 Wostry
5,244,446 A 9/1993 Engel et al.
5,256,126 A 10/1993 Grotstein
D341,176 S 11/1993 Habing et al.
5,263,914 A 11/1993 Simonson et al.
5,263,915 A 11/1993 Habing
5,265,589 A 11/1993 Wang
5,267,930 A 12/1993 Henes
5,273,504 A 12/1993 Jones
5,273,505 A 12/1993 Jones
5,273,509 A 12/1993 Vittone
5,277,681 A 1/1994 Holt
5,282,776 A 2/1994 Dalebout
RE34,572 E 3/1994 Johnson et al.
5,290,214 A 3/1994 Chen
5,295,931 A 3/1994 Dreibelbis et al.
RE34,577 E 4/1994 Habing et al.
5,299,992 A 4/1994 Wilkinson
5,300,003 A 4/1994 Hull
5,302,161 A 4/1994 Loubert et al.
5,304,107 A 4/1994 Jones
5,306,221 A 4/1994 Itaru
D347,251 S 5/1994 Dreibelbis et al.
5,308,303 A 5/1994 Rawls et al.
5,308,304 A 5/1994 Habing
5,310,392 A 5/1994 Lo
5,312,313 A 5/1994 Holmes et al.
5,316,528 A 5/1994 Ziparo
5,316,534 A 5/1994 Dalebout et al.
5,320,592 A 6/1994 Olschansky et al.
5,322,489 A 6/1994 Webb et al.
5,324,246 A 6/1994 Wang
5,328,428 A 7/1994 Huang
5,330,405 A 7/1994 Habing et al.
5,330,408 A 7/1994 Westmoreland, Jr.
5,334,113 A 8/1994 Roepke
5,336,140 A 8/1994 LeBlond
5,336,148 A 8/1994 Ish, III
5,342,270 A 8/1994 Jones
5,344,374 A 9/1994 Telle
5,346,447 A 9/1994 Stearns
5,348,524 A 9/1994 Grant
5,354,248 A 10/1994 Rawls et al.
5,356,360 A 10/1994 Johns
5,362,290 A 11/1994 Huang
5,366,426 A 11/1994 Glavin
5,366,432 A 11/1994 Habing et al.
5,374,229 A 12/1994 Sencil
5,378,216 A 1/1995 Ish, III et al.
5,380,258 A 1/1995 Hawley, Jr.
5,382,212 A 1/1995 Davenport et al.
5,387,170 A 2/1995 Rawls et al.
5,395,295 A 3/1995 Ish, III
5,399,133 A 3/1995 Haber et al.
5,403,257 A 4/1995 Lehtonen
5,409,435 A 4/1995 Daniels
D358,183 S 5/1995 Habing et al.
D358,625 S 5/1995 Enriquez, Jr.
5,413,546 A 5/1995 Basile
5,417,633 A 5/1995 Habing
5,417,634 A 5/1995 Habing
D359,326 S 6/1995 Deola
5,421,796 A 6/1995 Jones et al.
5,429,569 A 7/1995 Gunnari et al.
5,431,617 A 7/1995 Rattray, Jr.
5,433,680 A 7/1995 Knudsen
5,435,798 A 7/1995 Habing et al.
5,435,799 A 7/1995 Lundin
5,437,589 A 8/1995 Habing
5,441,470 A 8/1995 Chen
5,456,644 A 10/1995 Hecox et al.
5,466,204 A 11/1995 Nearing
5,468,202 A 11/1995 Habing
5,468,205 A 11/1995 McFall et al.
5,470,299 A 11/1995 Yeh
5,484,365 A 1/1996 Jones et al.
5,486,150 A 1/1996 Randolph
5,487,714 A 1/1996 Ferrari
5,492,386 A * 2/1996 Callum ..... 296/64
5,499,959 A 3/1996 Holmes et al.
D368,501 S 4/1996 Woodruff
5,511,740 A 4/1996 Loubert et al.
D370,040 S 5/1996 Habing et al.
5,518,477 A 5/1996 Simonson
D370,949 S 6/1996 Furner
D371,176 S 6/1996 Furner
5,527,243 A 6/1996 Chen
5,527,245 A 6/1996 Dalebout et al.
5,533,953 A 7/1996 Lui et al.
5,542,895 A 8/1996 Colbo, Jr.
5,549,530 A 8/1996 Fulks
5,549,533 A 8/1996 Olson et al.
5,554,084 A 9/1996 Jones
5,554,085 A 9/1996 Dalebout
5,554,086 A 9/1996 Habing et al.
5,554,089 A 9/1996 Jones
5,554,090 A 9/1996 Jones
5,562,577 A 10/1996 Nichols, Sr. et al.
5,580,337 A 12/1996 Habing et al.
5,580,340 A 12/1996 Yu
5,580,341 A 12/1996 Simonson
5,582,564 A 12/1996 Nichols, Sr. et al.
5,586,962 A 12/1996 Hallmark
5,588,942 A 12/1996 Dillard
5,591,105 A 1/1997 Dalebout et al.
5,597,257 A 1/1997 Habing
5,599,256 A 2/1997 Hughes, Jr.
5,601,518 A 2/1997 Weintraub
RE35,470 E 3/1997 Jones
5,616,107 A 4/1997 Simonson
5,616,110 A 4/1997 Nascimento
5,616,111 A 4/1997 Randolph
5,624,362 A 4/1997 Wilson
5,626,548 A * 5/1997 Coyle ..... 482/137
5,628,715 A * 5/1997 Simonson ..... 482/97
D380,024 S 6/1997 Novak et al.
5,637,059 A 6/1997 Dalebout
5,643,151 A 7/1997 Naimo
5,655,997 A 8/1997 Greenberg et al.
5,665,036 A 9/1997 Hsieh
5,667,464 A 9/1997 Simonson 5,669,861 A 9/1997 Toups
5,669,865 A 9/1997 Gordon
5,674,167 A 10/1997 Piaget et al.
5,681,079 A * 10/1997 Robinson ..... 297/61
5,692,997 A 12/1997 Stearns
5,709,633 A 1/1998 Sokol
5,713,823 A 2/1998 Walendzak et al.
5,716,308 A 2/1998 Lee
5,718,654 A 2/1998 Kennedy
5,722,921 A 3/1998 Simonson
5,722,922 A 3/1998 Watterson et al.
5,725,459 A 3/1998 Rexach
5,733,229 A 3/1998 Dalebout et al.
5,733,233 A 3/1998 Webber
5,738,616 A 4/1998 Robertson
5,755,645 A 5/1998 Miller et al.
5,762,584 A 6/1998 Daniels
5,769,757 A 6/1998 Fulks
5,769,766 A 6/1998 Huang
5,776,040 A 7/1998 Webb et al.
5,788,615 A 8/1998 Jones
5,800,321 A 9/1998 Webber
5,803,882 A 9/1998 Habing et al.
5,807,219 A 9/1998 Webber et al.
5,810,698 A 9/1998 Hullett et al.
5,810,701 A 9/1998 Ellis et al.
5,820,529 A 10/1998 Weintraub
5,827,157 A 10/1998 Lee
5,836,858 A 11/1998 Sharff
5,839,997 A 11/1998 Roth et al.
5,860,894 A 1/1999 Dalebout
5,876,313 A 3/1999 Krull
5,885,193 A 3/1999 Habing et al.
5,888,179 A 3/1999 Singhal
5,897,467 A 4/1999 Habing et al.
5,904,638 A 5/1999 Habing et al.
5,906,566 A 5/1999 Whitcomb
5,921,897 A 7/1999 Stevens
5,921,902 A 7/1999 Carpenter
5,931,767 A 8/1999 Morales
5,938,551 A 8/1999 Warner
5,944,641 A 8/1999 Habing
D413,948 S 9/1999 Dalebout
5,951,448 A 9/1999 Bolland
5,961,427 A 10/1999 Habing et al.
5,961,428 A 10/1999 Webber
5,964,684 A 10/1999 Sokol
5,967,954 A 10/1999 Habing
5,971,895 A 10/1999 Habing
5,989,165 A 11/1999 Giannelli et al.
6,004,247 A 12/1999 Webber
6,004,248 A 12/1999 Price
6,022,299 A 2/2000 Stewart
6,027,429 A 2/2000 Daniels
6,056,678 A 5/2000 Giannelli et al.
6,059,701 A 5/2000 George et al.
6,090,020 A 7/2000 Webber
6,099,440 A 8/2000 Schurter et al.
6,117,055 A 9/2000 Boland
6,120,416 A 9/2000 Walker
6,120,421 A 9/2000 Kuo
D431,615 S 10/2000 Webber et al.
6,126,580 A 10/2000 Francis et al.
6,186,927 B1 2/2001 Krull
6,206,812 B1 3/2001 Nizamuddin
6,217,493 B1 4/2001 Spletzer
6,220,993 B1 4/2001 Sencil
6,224,514 B1 5/2001 Price
6,238,323 B1 5/2001 Simonson
6,251,052 B1 6/2001 Simonson
6,257,997 B1 7/2001 Doble et al.
6,258,016 B1 7/2001 Kuo
6,261,022 B1 7/2001 Dalebout et al.
6,264,586 B1 7/2001 Webber
6,264,588 B1 7/2001 Ellis
6,287,241 B1 9/2001 Ellis
6,296,596 B1 10/2001 Alessandri et al.
6,319,178 B1 11/2001 Webber
D455,803 S 4/2002 Webber
6,371,896 B1 4/2002 Kettler
6,394,937 B1 5/2002 Voris
6,402,666 B1 6/2002 Krull
6,409,631 B1 6/2002 Alessandri
6,422,979 B1 7/2002 Krull
6,440,044 B1 8/2002 Francis et al.
6,443,877 B1 9/2002 Hoecht et al.
6,447,430 B1 9/2002 Webb et al.
6,458,061 B1 10/2002 Simonson
6,471,624 B1 10/2002 Voris
6,482,139 B1 11/2002 Haag
6,488,612 B1 12/2002 Sechrest et al.
6,491,609 B1 12/2002 Webber
6,491,610 B1 12/2002 Henn
6,500,106 B1 12/2002 Fulks
6,551,226 B1 4/2003 Webber et al.
6,561,960 B1 5/2003 Webber
6,579,213 B1 6/2003 Webber et al.
6,585,626 B1 7/2003 McBride
6,592,498 B1 7/2003 Trainor
6,595,905 B1 7/2003 McBride
6,605,022 B1 8/2003 Webber
6,652,426 B1 11/2003 Carter et al.
6,652,429 B1 11/2003 Bushnell
6,669,606 B1 12/2003 Krull
6,669,609 B1 12/2003 Gerschefske et al.
6,685,607 B1 2/2004 Olson
6,743,158 B1 6/2004 Giannelli et al.
6,746,378 B1 6/2004 Morris et al.
6,770,017 B1 8/2004 Leipheimer
6,830,542 B1 12/2004 Ball et al.
6,910,994 B1 6/2005 Mitchell et al.
6,913,565 B1 7/2005 Mitchell et al.
2002/0035017 A1 3/2002 Pertegaz-Esteban
2002/0077230 A1 6/2002 Lull et al.
2002/0198087 A1 12/2002 Mitchell et al.
2002/0198088 A1 12/2002 Vuumans et al.
2003/0017918 A1 1/2003 Webb et al.
2003/0022767 A1 1/2003 Webber
2003/0032531 A1 2/2003 Simonson
2003/0045406 A1 3/2003 Stone
2003/0092543 A1 5/2003 Giannelli
2003/0096681 A1 5/2003 Myers et al.
2003/0100413 A1 5/2003 Huang
2003/0114281 A1 6/2003 Mackert et al.
2003/0176261 A1 9/2003 Simonson et al.
2003/0232707 A1 12/2003 Dalebout et al.
2004/0002409 A1 1/2004 Webb et al.
2004/0009856 A1 1/2004 Hammer
2004/0009857 A1 1/2004 Webb et al.
2004/0023762 A1 2/2004 Lull et al.
2004/0091307 A1 5/2004 James
2004/0176223 A1 9/2004 Morris et al.

FOREIGN PATENT DOCUMENTS

CA 1 184 577 3/1985
CA 1 199 946 1/1986
CA 1 203 822 4/1986
CA 1 256 136 6/1989
DE 2346105 A1 3/1975
DE 3 300 073 A1 7/1984
DE G 92 13 188.3 11/1992
DE G 94 11 573.7 9/1994
DE 43 20 887 A1 2/1997
DE 43 20 887 C2 2/1997
DE 198 01 672 A1 11/1998

| | | | |
|---|---|---|---|
| EP | 121902 | A1 | 10/1984 |
| EP | 177017 | A2 | 4/1986 |
| EP | 177643 | A1 | 4/1986 |
| FR | 824654 | | 2/1938 |
| FR | 2612406 | A1 | 9/1988 |
| FR | 2613237 | A1 | 10/1988 |
| FR | 2627090 | A1 | 8/1989 |
| GB | 325435 | | 2/1930 |
| GB | 466901 | | 6/1937 |
| GB | 1 151 656 | | 5/1969 |
| GB | 2 223 686 | A | 4/1990 |
| GB | 2 232 089 | A | 12/1990 |
| NL | 8800024 | | 1/1989 |
| SU | 1253654 | | 8/1986 |
| SU | 1258447 | A1 | 9/1986 |
| SU | 1367987 | A1 | 1/1988 |
| SU | 1 725 744 | A3 | 4/1992 |
| SU | 1743620 | | 6/1992 |
| TW | 210014 | | 7/1993 |
| TW | 317755 | | 10/1997 |
| TW | 331154 | | 5/1998 |
| TW | 364363 | | 7/1999 |
| WO | WO 86/06644 | A1 | 11/1986 |
| WO | WO 90/09212 | A1 | 8/1990 |
| WO | WO 92/18202 | A1 | 10/1992 |
| WO | WO 94/14505 | A1 | 7/1994 |
| WO | WO 96/26765 | A1 | 9/1996 |
| WO | WO 01/19462 | A1 | 3/2001 |
| WO | WO 01/66195 | A2 | 9/2001 |

OTHER PUBLICATIONS

"8300s Series II Strength System," Schwinn Cycling & Fitness Inc., one page of product brochure showing 8300 Series II Strength System, 1 page (1999).
BFit® University Presents Bally "Total Fitness PowerPump the Official Barbell Workout," Training Manual (1998).
The Body Bar, "A Total Body Conditioning Bar," brochure, The Step Company (1995).
Body Masters MD 504 Pec Contractor & Rear Deltoid Machine, brochure (1994).
Body Pump™, "Aerobic Market 'Pumped Up' about New Zealand's Body Pump™ Program," Press Release, Les Mills International/The STEP Company, date unknown.
Body Pump™, "Anybody and Everybody Wants to . . . Become Some Body" Brochure, A Product of The STEP Company and Developed by Les Mills Aerobics, date unknown.
Body Pump™, "Become Some Body!", Press Release, Les Mills International/The STEP Company, date unknown.
Body Pump™, Instructor Manual Version II ©, Les Mills International/The STEP Company (1998).
Body Pump™, "Taking a Good Idea One STEP Further," Press Release, The Step Company/Les Mills International, date unknown.
Body Pump™, Trainer Manual Version II ©, Les Mills International/The STEP Company (1998).
Body Pump Training Brochure, The STEP Company/Les Mills International, date unknown.
Bowflex advertisement flyer and order form "Special Offer! Order in 30 days and Receive an Extra 100lbs of Power Rods FREE!", 10 pages (1992).
"Bowflex Fitness", Bowflex, Inc., catalog, 8 pages (1998).
"Cross Bow by Weider How Does the Crossbow Stack up Against the Competition", ICON Health and Fitness, located at http://www.iconfitness.com/crossbow/cb_vs_bf.html, 2 pages (retrieved Oct. 22, 2002).
Cybex International, Inc., Commercial Strength Systems brochure, 4535 Arm Curl, 5255 Rear Delt, 5281 Arm Curl, pp. 9 and 36 (Apr. 2000).
Cybex International, Inc., Cybex Eagle Premier Strength brochure, 11080 Arm Extension, p. 8 (May 2002).
Cybex World, "New Products Prove Passion for Human Performance," vol. 10, Issue 2 (Jul. 2000).
"HD 1800 Inner/Outer Thigh," Hoist Fitness Systems, Inc., located at http://www.hoistfitness.com, 3 pages (retrieved Apr. 30, 2004).
Introducing . . . Nautilus for Women by Dan Baldwin, National Fitness Trade Journal, pp. 44-47, date unknown.
Johnny G Spinning © Instructor Manual (Copyright 1995).
Keiser® Power Pacer, Instructor Training Manual ©, by Keiser Corporation (1997, 1998).
"MG-32 Ski Machine" and "MG-034 Simple Body Stretcher", Modas Shing Co., Ltd., 1 page, undated.
*Maximize Your Performance*, "the ultimate workout" Versatrainer by Pro-Max, 1 page, undated.
Nautilus catalog, 92 pages, undated.
Nautilus® Fitness Accessories 2001 brochure, 15 pages (2001).
Nautilus® Free Weight Equipment 2001 brochure, 11 pages (2001).
Nautilus® Home Gyms 2001 brochure, 11 pages (2001).
"Nautilus Next Generation Product Line", Nautilus catalog, 8 pages, undated.
Nautilus, The Next Generation catalog, 48 pages, undated.
Nautilus NS-4000 picture, one page, undated.
Nautilus Super Smooth Technology, "Equipment Comparison", undated brochure, one page, undated.
"Nautilus Time Machine," Nautilus Inc., cover page of product brochure and one page therefrom, 2 pages, undated.
Nebula Fitness Equipment by Proto Weld, Inc., 4005—Lever Row Swivel Adjustments, brochure.
New Fitness Trend Guarantees Company's Success, Press Release, The STEP® Company, undated.
"Odyssey 5" Home Gym, TuffStuff, cover page of product brochure and three images therefrom, 2 pages (2001).
Powerline by TuffStuff, Task Industries Inc., PL-221, Leg Curl/Extension Combo, undated brochure.
Schwinn Cycling & Fitness Inc., "Airdyne® Backdraft™ Recumbent Bike" (1996).
Schwinn Cycling & Fitness Inc., "Airdyne® Windsprint™ Interval Bike" (1996).
Schwinn® Fitness, "Harness the Force of Nature and You Possess the Strength of Confidence" brochure 30 pages (1996-1997).
Schwinn Iron Classic Strength Training System by Bowflex® Owner's Manual, 55 pages (1993).
The Slide Home Trainer, "The Professional, Portable Home Slide," brochure, The Step Company (1995).
The Slide Trainer The Professional Slideboard, "The Professional Slideboard," brochure, The Step Company (1995).
Soloflex catalog, p. 23 (1981).
"Stamina LT-2000 Band Flex Gym", Stamina Products, Inc., located at Egghead.com, 3 pages (at least as early as Mar. 9, 2001).
"The Standing Firm System", located at http://www.standing-pilates.com, 6 pages (retrieved Sep. 29, 2004).
The STEP® Company Club Price List, Les Mills International/The Step Company (May 1998).
The Step® Home Trainer, "The Intermediate Home Step System," brochure, The Step Company (1995).
The Step® Home Workout System, "The Compact Professional Step Trainer," brochure, The Step Company (1995).
The Step, "The Original Health Club Step," brochure, The Step Company (1995).
The Step, "The Professional Club Model," brochure, The Step Company (1995).
The Studio Step, "The Compact Club Model," brochure, The Step Company (1995).
TuffStuff, TUB-49 Upper Body Machine, brochure.
Universal 1981-82 catalog, p. 12 (Jun. 1, 1981).
"V5 Multi Gym," Hoist Fitness Systems, Inc., located at http://www.hoistfitness.com, 3 pages (retrieved Apr. 30, 2004).
Little, John, Chest Essentials, Muscle & Fitness, pp. 138-144 (Sep. 1995).

* cited by examiner

COLLAPSIBLE SEAT FOR COMBINATION HACK SQUAT AND LEG PRESS MACHINE

BACKGROUND OF THE INVENTION

1. Field of the Invention

This invention relates to exercise equipment and machines for home commercial use.

2. Description of the Related Art

Specialized exercise and fitness equipment and machines are typically designed to focus resistance forces to work particular muscle groups of a user. Exercise machines and other fitness equipment are often designed to provide more than one type of exercise. Such combination designs are more resource efficient than exercise machines that only provide one exercise, both in terms of cost and accommodation. Cost savings are realized if one machine or piece of equipment can offer multiple exercises in lieu of many machines or pieces of equipment individually offering only one of the exercises. More efficient accommodation is realized because combination exercise machines generally occupy less space than the multiple exercise machines otherwise required to offer the same exercises.

Often, however, combination fitness equipment or exercise machines can be difficult to reconfigure, requiring actual dismantling or physical detachment and relocation of pieces of portions of the equipment or machine. Such difficulties have heretofore been the norm when attempting to provide exercises using an inclined weight sled. Two of the more popular exercises using an inclined weight sled are a hack squat exercise and a leg press exercise. In order to perform a hack squat exercise with a weight sled, an inclined foot plate must be provided for the user to stand upon. To reconfigure the weight sled for a leg press exercise, the inclined foot plate must be removed and replaced with an inclined seat. Further, the shoulder engagement assembly used when performing a hack squat must be removed and replaced with a foot plate attached to the weight sled.

SUMMARY OF THE INVENTION

In one embodiment of the invention, an exercise machine for performing both a hack squat exercise and a leg press exercise is disclosed. The exercise machine is composed of a frame that supports a weight sled, which is operable along the frame. A leg press foot plate is operably mounted to the weight sled for use in performing a leg press exercise. Similarly, a shoulder engaging system is operably mounted to the weight sled for use in performing a hack squat exercise. The leg press foot plate and the shoulder engaging system are provided as alternative configurations whereby only one of either the leg press foot plate or the shoulder engaging system can be used by a user at one time. A hack squat platform is also operably mounted to the frame for use in performing a hack squat exercise. Further, a collapsible seat is operably connected to either the frame or the hack squat platform for use in performing a leg press exercise. Regardless of the connection point of the collapsible seat, it is otherwise operably engaged with the hack squat platform. The collapsible seat and the hack squat platform are provided as alternative configurations whereby only one of either the collapsible seat or the hack squat platform can be used by the user at one time.

Another embodiment of the invention concerns a combination collapsible seat and hack squat platform for use in conjunction with an exercise machine. The collapsible seat is composed of a head portion, a back portion, and a seat portion. The back portion is operably connected to the head portion and the seat portion is operably connected to the back portion. The hack squat platform is composed of a frame, a foot plate supported by the frame, and an incline means operably connected to either the frame, the foot plate or both. The frame is also operably connected to the seat portion of the collapsible seat. The incline means allows an end of the foot plate to be raised at an angle to a surface upon which the hack squat platform rests. When the collapsible seat is in an open configuration, the back portion is supported by the foot plate. When the collapsible seat is in a collapsed configuration, the head portion folds against the back portion, the back portion folds against the seat portion, and the foot plate is exposed for use by a user.

The invention is described in another embodiment as a collapsible seat for use in conjunction with an inclined platform. The collapsible seat is composed of a head portion, a back portion, and a seat portion. The back portion is operably connected to the head portion and the seat portion is operably connected to the back portion. When the collapsible seat is in an open configuration, the back portion is supported by the inclined platform. When the collapsible seat is in a collapsed configuration, the head portion folds against the back portion, and the back portion folds against the seat portion.

Other features, utilities and advantages of various embodiments of the invention will be apparent from the following more particular description of embodiments of the invention as illustrated in the accompanying drawings and defined in the appended claims.

DETAILED DESCRIPTION OF THE INVENTION

Figure 1:
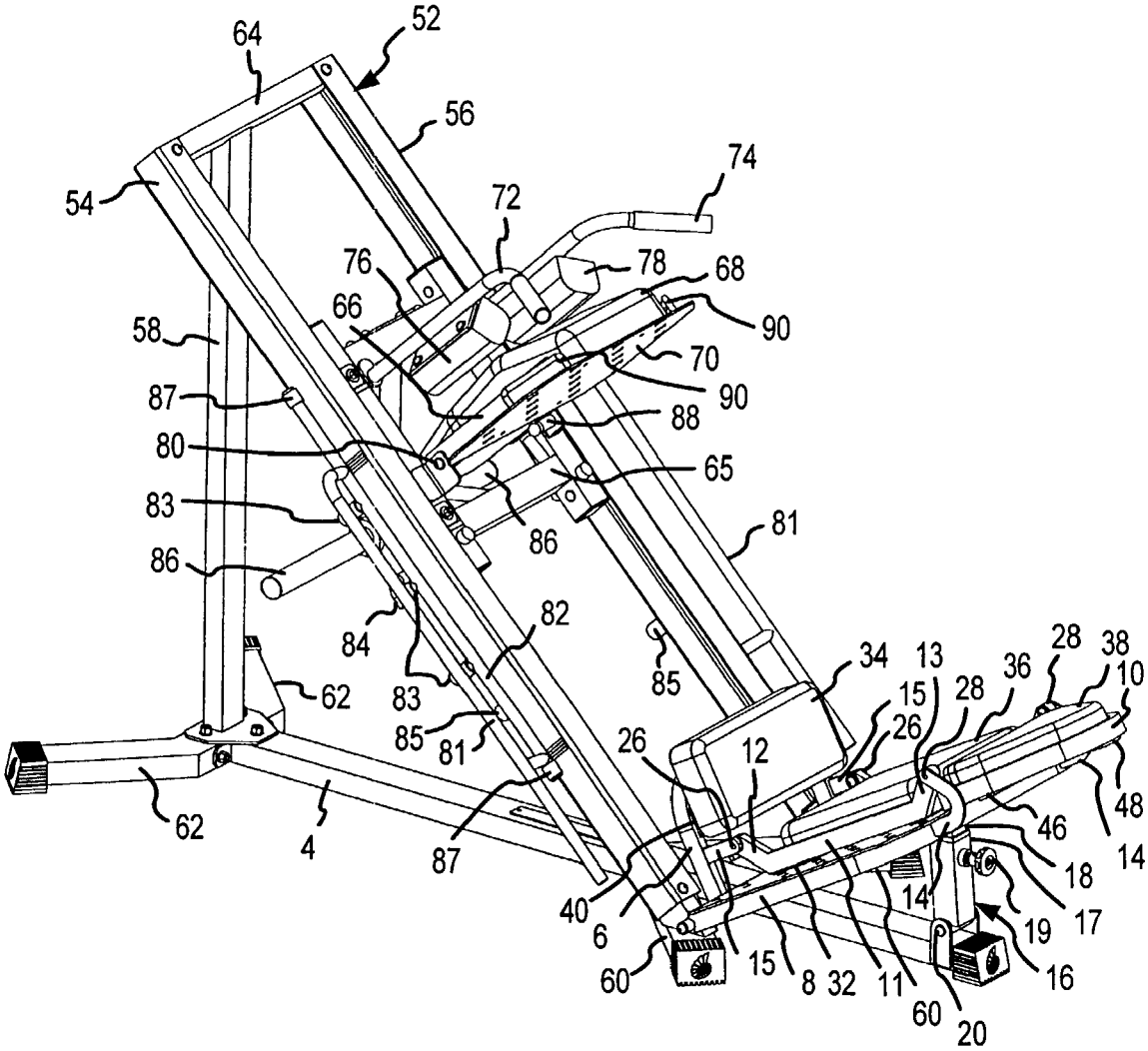
FIG. 1 is an isometric view of a hack squat/leg press machine in a leg press configuration according to one embodiment of the invention.
Figure 2:
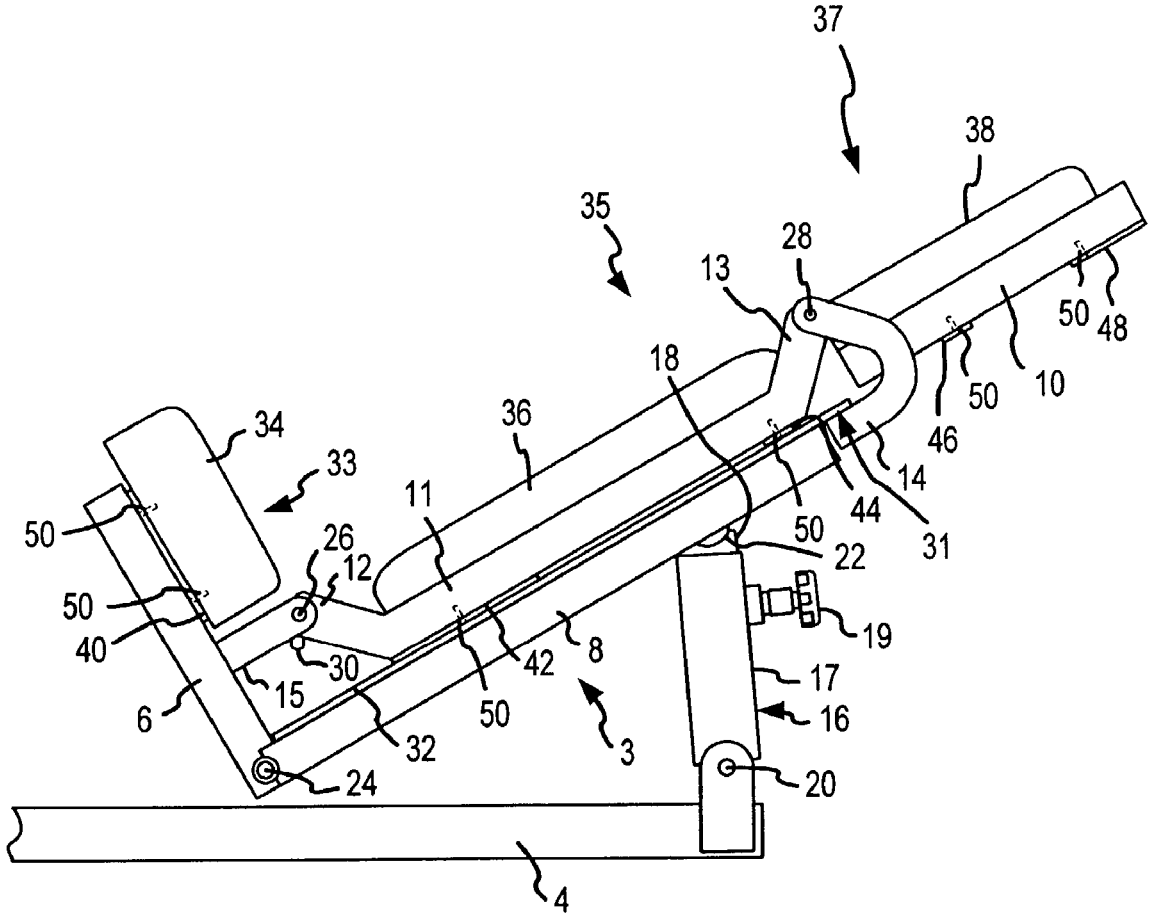
FIG. 2 is a side elevation of a collapsible seat for use with the hack squat/leg press machine of FIG. 1.

The present invention concerns the novel design of a combination collapsible seat and hack squat platform that allows a hack squat weight sled to be easily transformed into a leg press machine. The invention additionally discloses the use of the collapsible seat in combination with a shoulder engaging system that is easily converted into a foot plate in a leg press configuration. As shown in FIG. 1, the collapsible seat 2 is positioned at the base of an inclined hack squat/leg press machine 52 on top of a hack squat platform 3 (see FIG. 6). As shown in greater detail in FIG. 2, the collapsible seat 2 is composed of three primary sections: a seat portion 33, a back portion 35, and a head portion 37. The collapsible seat 2 is operably mounted on a base frame 4 of the hack squat/leg press machine 52. The collapsible seat 2 may be primarily supported by a seat frame 6 and a foot plate frame 8 of the hack squat platform 3. The seat frame 6 may be operably connected to the foot plate frame 8 by a base hinge 24. The base hinge 24 may further be operably connected to the base frame 4. When the collapsible seat 2 is in a full open position, the seat frame 6 is positioned at a 90° angle to the foot plate frame 8.

The foot plate frame 8 is operably connected at a distal end from the base hinge 24 to an angle adjustment post 16 by an upper post hinge 22. The opposite end of the angle adjustment post 16 may be operably connected to the base frame 4 by a lower post hinge 20. The angle adjustment post may be composed of a post sleeve 17 within which a riser post 18 may operably slide up and down. The top of the riser post 18 may be operably attached to the upper post hinge 22 and thereby connected to the foot plate frame 8. The riser post 18 may contain a series of apertures along one side which may be engaged by pop pin 19 to hold the riser post 18 in a particular position with respect to post sleeve 17. By moving the riser post 18 up and down within the post sleeve 17 and selecting a location for engagement by the pop pin 19, the angle adjustment post 16 may provide a varying angle of incline to the collapsible seat 2 (or to the hack squat platform 3 as described in greater detail with respect to FIG. 6, infra).

As indicated, the collapsible seat 2 may be viewed as a combination of three sections, the seat portion 33, the back portion 35, and the head portion 37. The seat portion 33 is supported by the seat frame 6 upon which is mounted a seat cushion 34. In the embodiment depicted in FIGS. 1–5, the seat frame 6 may be formed in a U-shape with a seat plate spanning space between and traverse to the arms of the "U," which in this case are oriented downward to attach to the base hinge 24. The seat plate 40 may be used to provide support for the seat cushion 34 between the arms of the U-shaped seat frame 6. The seat cushion 34 may be mounted to points along the seat frame 6 and the seat plate 40 by bolts 50.

The back portion 35 may be generally supported by the foot plate frame 8. The foot plate frame 8 may be composed of two parallel side members spanned by a foot plate 32, which is fixedly mounted to the foot plate frame 8. Each parallel member of the foot plate frame 8 may be operably attached to an arm of the inverted "U" of the seat frame 6. In this embodiment, there may be a base hinge 24 at each connection between the seat frame 6 and the foot plate frame 8. A back rest cushion 36 is supported by the foot plate 32 when the collapsible seat 2 is in its full open position. The back rest cushion 36 may be mounted on a back rest frame 11. Similar to the foot plate frame 8, the back rest frame 11 may be composed of two parallel members. A back rest plate 42 may be mounted transverse to and span the space between the parallel members of the back rest frame 11 toward the lower end of the back portion 35 to provide support for the back rest cushion 36. Similarly, a back rest band 44 may be mounted transverse to and span the distance between the parallel members of the back rest frame 11 toward the upper end of the back portion 35 to likewise provide support for the back rest cushion 36. The back rest cushion 36 may be mounted to the back rest plate 42 and the back rest band 44 by bolts 50.

Each of the parallel members of the back rest frame 11 may extend beyond the back cushion 36 at the lower end of the back portion 35 at an angle extending away from the foot plate 32 to form lower angle pivot bars 12. The lower angle pivot bars 12 may be operably connected by lower seat hinge 26 to respective adjoining seat pivot bars 15 extending perpendicular to the arms of the U-shaped seat frame 6. The connections between the lower angle pivot bars 12 and the seat pivot bars 15 maintain the angled relationship between the seat portion 33 and the back portion 35 when the collapsible seat 2 is in the fully open position. A stop weld 30 may be provided on either the lower angle pivot bars 12 or the seat pivot bars 15 closely adjacent the lower seat hinge 26. The stop weld 30 helps impede the back rest frame 11 from sliding downward along the foot plate 32, which could cause additional rotation of the seat portion 33 about the base hinge 24 in combination with rotation of the lower angle pivot bars 12 and the seat pivot bars 15 about lower seat hinge 26. The stop weld 30 thereby helps maintain a 90° angle between the seat portion 33 and the back portion 35 when the collapsible seat 2 is in a fully opened configuration.

Toward the upper end of the back portion 35, each of the parallel members of the back rest frame 11 may extend upward beyond the back cushion 36 at an angle to the foot plate 32 to form upper angled pivot bars 13. Each of the upper angled pivot bars 13 may be operably connected to respective head rest latches 14 by upper seat hinges 28. Each of the head rest latches 14 may be fixably mounted to a head rest frame 10 that supports a head cushion 38 to form the head portion 37 of the collapsible seat 2. The head rest frame 10 may be formed in an A-shape with a head rest band 46 fixedly mounted substantially transverse to and spanning the space between each of the legs of the A-shaped head rest frame 10. A head rest tab 48 may further extend from the top of the A-shaped head rest frame 10 underneath the head cushion 38. The head cushion 38 may be supported by the head rest band 46 and the head rest tab 48, and may be further mounted to the same by bolts 50.

The head rest latches 14 may be formed in an arcuate or an angled shape, like hooks, to bend back underneath an upper lip 31 of the foot plate 32. In this manner, an edge of the head rest latch 14 hooks around the top of the foot plate 32 and engages the underside of the upper lip 31 of the foot plate 32 and prevents further rotation of the head portion 37 about the upper seat hinges 28 with respect to the back portion 35. Further, the head portion 37 is held in a cantilevered position whereby the surface of the head cushion 38 is in the same plane as the surface of the back cushion 36. The head rest latches 14 likewise help impede the back rest frame 11 from sliding downward along the foot plate 32, thereby helping maintain a 90° angle between the seat portion 33 and the back portion 35.

Figure 3:
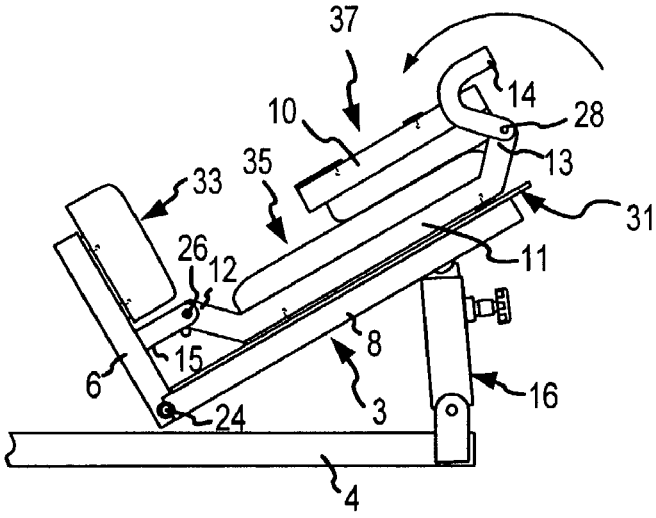
FIG. 3 is a side elevation of the collapsible seat of FIG. 2 in a first partially collapsed position.
Figure 4:
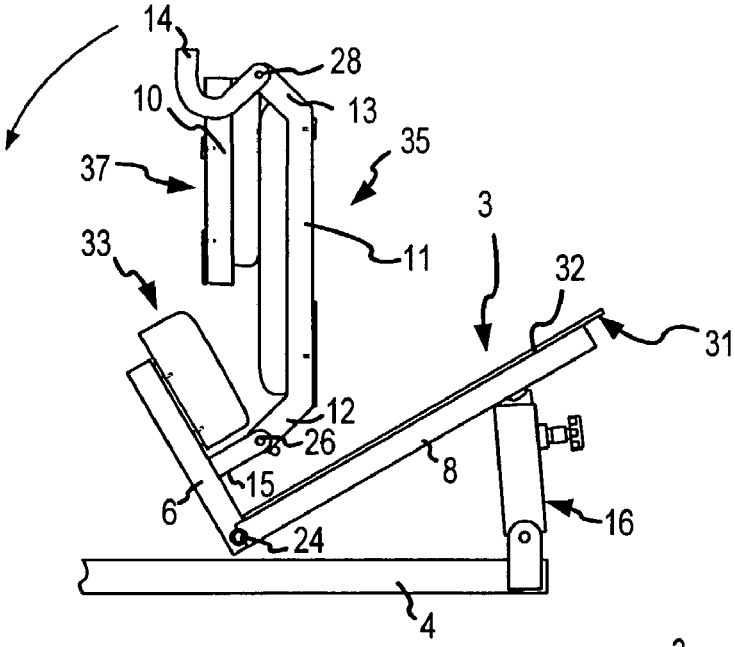
FIG. 4 is a side elevation of the collapsible seat of FIG. 2 in a second partially collapsed position.
Figure 5:
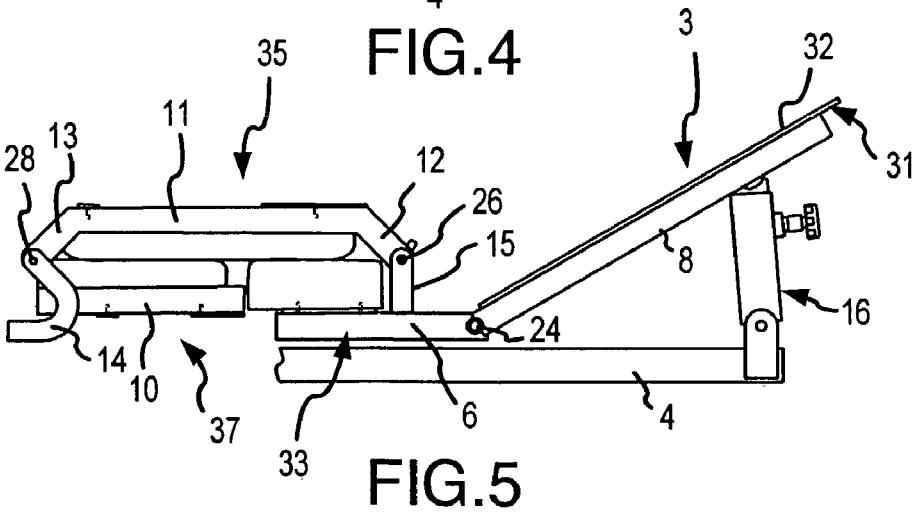
FIG. 5 is a side elevation of the collapsible seat of FIG. 2 in a fully collapsed position.

The operation of the collapsible seat 2 is depicted in FIGS. 3, 4, and 5. In FIG. 3, the head portion 37 is rotated around the upper seat hinges 28 to fold against the back portion 35. In this configuration, the surface of the head cushion 38 lays against the surface of the back cushion 36. This operation is facilitated by locating the upper seat hinge 28 in the same plane as the surfaces of the back cushion 36 and head cushion 38. It should be noted that at this point the weight of the back portion 35 and head portion 37 on the foot plate 32 and the frictional engagement between the back rest frame 11 seated upon the foot plate 32 helps impede the rotation of the collapsible seat 2 about either the lower seat hinge 26 or the base hinge 24.

FIG. 4 depicts an operation of rotating the back portion 35 and the head portion 37 about the lower seat hinge 26. This rotational movement uncovers the hack squat platform 3 for use by a user. Further, once the back portion 35 and the head portion 37 are lifted from their frictional engagement with the foot plate 32 and the center of mass of the head portion 37 and back portion 35 shifts toward the seat portion 33, rotation of the collapsible seat 2 about the base hinge 24 also occurs.

As shown in FIG. 5, the operation is completed when the seat portion 33 is rotated about base hinge 24 such that the seat frame 6 is parallel to upon the base frame 4 and the head rest frame 10 and the back rest frame 11 are likewise parallel to and rest the base frame 4. In this manner, the back portion 35 is maintained in a position parallel to the floor when the collapsible seat 2 is fully collapsed. Once the collapsible seat 2 is fully collapsed, the foot plate 32 of the hack squat platform 3 is exposed whereby a user may stand on the inclined foot plate 32 to perform a hack squat exercise on the hack squat/leg press machine 52. In this configuration, the back rest plate 42 may be used as a stepping surface to allow a user to position himself on the inclined foot plate 32 without damaging the back portion 35 of the collapsible seat 2. Both the foot plate 32 and the back rest plate 42 may be provided with a slip resistant surface, for example, diamond-patterned protrusions in the surfaces of the foot plate 32 and the back rest plate 42. In an alternate configuration, the fully collapsed collapsible seat 2 may rest in an area that does not overlie the base frame 4. When the head portion 37 is rotated against the back portion 35, the head rest latches 14 may rotate such that the ends of the head rest latches 14 distal from the upper seat hinge 22 are at the same level as the seat frame 6. In this manner, the head rest latches 14 may rest against and elevate the head rest portion 37 slightly above the floor and maintain the back of the back rest 35 level with the floor.

Figure 6:
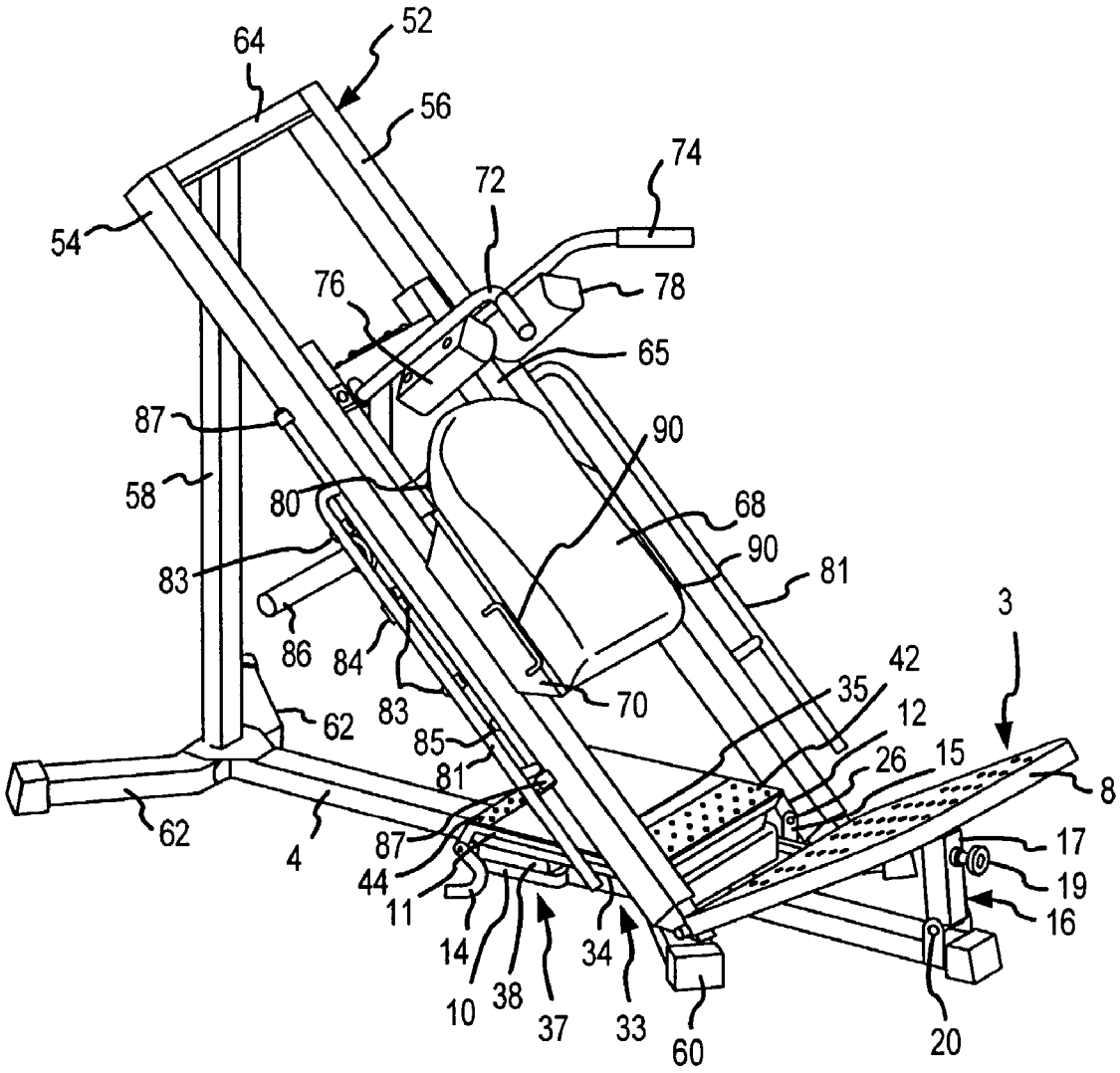
FIG. 6 is an isometric view of the hack squat/leg press machine of FIG. 1 in a hack squat configuration.

The collapsible seat 2 is shown in FIGS. 1 and 6 in context with one embodiment of a hack squat/leg press machine 52 providing for both a hack squat exercise and a leg press exercise. The hack squat/leg press machine 52 is composed of a left sled rail 54 spaced apart from a parallel right sled rail 56. A sled header 64 connects the upper ends of the left sled rail 54 and the right sled rail 56. The sled header 64 may be supported above the floor by a vertical sled column 58. The base of the sled column 58 may be attached to one end of the base frame 4. One or more rear stabilizer bars 62 may further be connected to sled column 58, the base frame 4, or both to provide greater stability to the sled column 58 and the upper portion of the hack squat/leg press machine 52. The lower ends of the left sled rail 54 and the right sled rail 56 are configured adjacent to the floor and may be supported by front stabilizer bars 60, which may also be attached to the base frame 4. In this manner, the sled column 58 supports the left sled rail 54 and the right sled rail 56 at an angle to the floor. The collapsible seat 2 may be mounted on the opposite end of the base frame 4 and oriented generally facing the sled column 58. The base hinges 24 on the foot plate frame 8 may be mounted to the lower ends of the left sled rail 54 and the right sled rail 56.

As shown in FIG. 6, the collapsible seat 2 is collapsed revealing the foot plate 32 of the hack squat platform 3 for performing a hack squat exercise. The hack squat/leg press machine 52 may be provided with a configurable weight sled 65. The weight sled may have a weight tree 86 with branch members on either side for receiving free weights to provide a resistance force during an exercise. When not in use, a locking hook 84 extending from the side of the weight sled 65 may be operably engaged with one of several locking pegs 83 along a safety catch shaft 82 to hold the weight sled in a particular position along the left and right sled rails 54, 56. The engagement of the locking hook 84 and locking pegs 83 allows a user to safely mount and dismount the hack squat/leg press machine 52, to collapse or extend the collapsible seat 2, to configure the weight sled 65 with a sled foot plate 70 or a shoulder engaging system, to add or subtract weights from the weight tree 86, or to perform any other adjustment to the hack squat/leg press machine 52, without concern that the weight sled will slide downward along the left and right sled rails 54, 56, potentially causing injury. The locking pegs 83 are provided along safety catch shafts 82 mounted along the lengths of each of the left and right sled rails 54, 56 in safety catch bearings 87. The safety catch shafts 82 are mounted to safety catch rails 81 for operation by a user. In case of a failure of the safety catch pegs 83 or a mistake in operation by a user, safety stops are provided on each of the left sled rail 54 and the right sled rail 56 to prevent the weight sled 65 from falling any further than the mounting position of the safety stops 85.

The weight sled 65 may have a shoulder engaging system in part composed of a sled back rest frame 66 with a sled back cushion 68 mounted on top of the sled foot plate 70. A sled foot plate 70 may be mounted opposite the sled back cushion 68 on the sled back rest frame 66. Grip bars 90 for grasping by a user may be mounted adjacent to the sled back cushion 68 on the back side of the sled foot plate 70 extending wider than the sled back cushion 68. A left handlebar 72 and a right handlebar 74 are mounted to the weight sled 65 above the sled back frame 66 for grasping by the hands of the user to aid in the performance of a hack squat exercise. A left shoulder pad 76 and a right shoulder pad 78 are mounted to the left handlebar 72 and the right handlebar 74, respectively for engaging the shoulders of the user during performance of a hack squat exercise.

To perform a hack squat exercise, the user stands on the foot plate 32 of the hack squat platform 3 with his back against the sled back cushion 68 and his shoulders against the left shoulder pad 76 and right shoulder pad 78. The user may adjust the angle of incline of the hack squat platform 3 by raising or lowering the riser post 18 in the angle adjustment post 16 before stepping onto the foot plate 32. The user may grasp the left and right handlebars 72, 74 with his hands while performing a hack squat exercise if desired.

In order to engage the weight sled 65, the user must lift the weight sled 65 a short distance to raise the locking hooks 84 to a position above the locking pegs 83 upon which the locking hooks 84 were resting. The user must then grasp each of the safety catch rails 81 and rotate them approximately 90° inward toward the respective adjacent sled rails 54, 56, thereby rotating the safety catch shaft 82 approximately 90° and moving the locking pegs 83 to positions at which the locking pegs 83 cannot be engaged by the locking hooks 84. The weight sled 65 is then able to move freely up and down the sled rails 54, 56 while the user alternately squats and stands upright in performance of the hack squat exercise. When the user has completed the exercise, he may rotate the safety catch rails 81, and thereby the safety catch shafts 82 and locking pegs, approximately 90° outward to move the locking pegs 83 into positions whereby the locking pegs 83 can be engaged by the locking hooks 84 and support the weight sled 65.

The sled back rest frame 66 may be operably mounted to the weight sled 65 by sled hinges 80. When a user desires to perform a leg press exercise, the sled pop pin 88 may be disengaged from the weight sled 55, thereby allowing the sled back rest frame 66 to rotate upward about the sled hinge 80 to a position normal the left sled rail 54 and the right sled rail 56. The sled pop pin 88 may then be reengaged with the weight sled 65 to hold the back rest frame 66 in this position normal to the sled rails 54, 56. In this configuration, the sled foot plate 70 mounted on the sled back rest frame 66 opposite the sled back cushion 68 is exposed for engagement by the feet of a user. To perform a leg press exercise, the user then needs to fully extend the collapsible seat 2 from its collapsed configuration reversing the steps for collapsing the collapsible seat 2 previously described herein with respect to FIGS. 3–5. The user may likewise change the angle of inclination of the collapsible seat 2 by raising or lowering the riser post 18 in the angle adjustment post 16. The user may then sit in the collapsible seat 2 and engage the sled foot plate 70 with his feet to perform a leg press exercise.

Again, in order to engage the weight sled 65, the user must lift the weight sled 65 a short distance to raise the locking hooks 84 to a position above the locking pegs 83 upon which the locking hooks 84 were resting. The user must then grasp each of the safety catch rails 81 and rotate them approximately 90° inward toward the respective adjacent sled rails 54, 56, thereby rotating the safety catch shaft 82 approximately 90° and moving the locking pegs 83 to positions at which the locking pegs 83 cannot be engaged by the locking hooks 84. The weight sled 65 is then able to move freely up and down the sled rails 54, 56 while the user alternately extends and contracts his legs in performance of a leg press exercise. When the user has completed the exercise, he may rotate the safety catch rails 81, and thereby the safety catch shafts 82 and locking pegs, approximately 90° outward to move the locking pegs 83 into positions whereby the locking pegs 83 can be engaged by the locking hooks 84 and support the weight sled 65.

Although various embodiments of this invention have been described above with a certain degree of particularity, or with reference to one or more individual embodiments, those skilled in the art could make numerous alterations to the disclosed embodiments without departing from the spirit or scope of this invention. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. An exercise machine for performing both a hack squat exercise and a leg press exercise comprising:

a frame;

a weight sled operably engaged with the frame;

a leg press foot plate operably mounted to the weight sled;

a shoulder engaging system operably mounted to the weight sled; wherein the leg press foot plate and the shoulder engaging system are alternative configurations whereby only one of the leg press foot plate and the shoulder engaging system can be used by a user at one time;

a hack squat platform operably mounted to the frame; and a collapsible seat operably connected to at least one of the frame and the hack squat platform and operably engaged with the hack squat platform; wherein the collapsible seat and the hack squat platform are alternative configurations whereby only one of the collapsible seat and the hack squat platform can be used by the user at one time; and wherein the collapsible seat further comprises:

a head portion;

a back portion operably connected to the head portion; and a seat portion operably connected to the back portion; wherein when the collapsible seat is in an open configuration, the back portion is supported by the hack squat platform; and when the collapsible seat is in a collapsed configuration, the head portion folds against the back portion, and the back portion folds against the seat portion.

2. The exercise machine of claim 1, wherein the hack squat platform further comprises:

a platform frame operably connected to the seat portion;

a foot plate supported by the frame; and an incline means operably connected to at least one of the platform frame and the foot plate, the incline means for raising an end of the foot plate at an angle to a surface upon which the hack squat platform rests; wherein when the collapsible seat is in an open configuration, the back portion is supported by the foot plate; and when the collapsible seat is in a collapsed configuration, the head portion folds against the back portion, the back portion folds against the seat portion, and the foot plate is exposed for use by a user.

3. The exercise machine of claim 1 further comprising a latch member mounted to the head portion and operably connected to the back portion, the latch member further engaging a bottom side of the foot plate and maintaining the head portion generally in the same plane as the back portion.

4. The exercise machine of claim 1, wherein when the collapsible seat is in an open configuration, the back portion and the head portion are generally in the same plane and the seat portion is held in a position generally normal to the back portion.

5. The exercise machine of claim 1, wherein when the collapsible seat is in a collapsed configuration, the seat portion and the head portion are generally in a first plane and the back portion is generally in a second plane parallel to the first plane.

6. The exercise machine of claim 1, wherein the shoulder engaging system is operably connected to the leg press foot plate.

7. The exercise machine of claim 1, wherein the shoulder engaging system further comprises:

a handlebar mounted to the weight sled;

a shoulder pad mounted to the handlebar; and a back rest operably mounted to the weight sled below the handlebar.

8. The exercise machine of claim 7, wherein the leg press foot plate is mounted to a back side of the back rest, and wherein the leg press foot plate is configurable for use by the user by rotating the backrest upward toward the handlebar into a position normal to the weight sled to expose the leg press foot plate for use by the user.

9. A combination collapsible seat and hack squat platform for use in conjunction with an exercise machine, the collapsible seat comprising:

a head portion;

a back portion operably connected to the head portion; and a seat portion operably connected to the back portion;

the hack squat platform comprising:

a frame operably connected to the seat portion;

a foot plate supported by the frame; and an incline means operably connected to at least one of the frame and the foot plate, the incline means for raising an end of the foot plate at an angle to a surface upon which the hack squat platform rests; wherein when the collapsible seat is in an open configuration, the back portion is supported by the foot plate; and when the collapsible seat is in a collapsed configuration, the head portion folds against the back portion, the back portion folds against the seat portion, and the foot plate is exposed for use by a user.

10. The combination collapsible seat and hack squat platform of claim 9, wherein when the collapsible seat is in an open configuration, the back portion and the head portion are generally in the same plane and the seat portion is held in a position generally normal to the back portion.

11. The combination collapsible seat and hack squat platform of claim 9, wherein when the collapsible seat is in a collapsed configuration, the seat portion and the head portion are generally in a first plane and the back portion is generally in a second plane parallel to the first plane.

12. The combination collapsible seat and hack squat platform of claim 9 further comprising a latch member mounted to the head portion and operably connected to the back portion, the latch member further engaging a bottom side of the foot plate and maintaining the head portion generally in the same plane as the back portion.

13. A collapsible seat for use in conjunction with an inclined platform, the collapsible seat comprising:

a head portion;

a back portion operably connected to the head portion; and a seat portion operably connected to the back portion;

a latch member mounted to the head portion and operably connected to the back portion, the latch member further engaging a bottom side of the inclined platform and maintaining the head portion generally in the same plane as the back portion; wherein when the collapsible seat is in an open configuration, the back portion is supported by the inclined platform; and when the collapsible seat is in a collapsed configuration, the head portion folds against the back portion, and the back portion folds against the seat portion.

* * * * *